US011735410B1

(12) United States Patent
Xu

(10) Patent No.: US 11,735,410 B1
(45) Date of Patent: Aug. 22, 2023

(54) FILAMENT SUPPORT AND LAMP

(71) Applicant: Qingjun Xu, Guangdong (CN)

(72) Inventor: Qingjun Xu, Guangdong (CN)

( * ) Notice: Subject to any disclaimer, the term of this patent is extended or adjusted under 35 U.S.C. 154(b) by 0 days.

(21) Appl. No.: 18/124,151

(22) Filed: Mar. 21, 2023

(30) Foreign Application Priority Data

Dec. 19, 2022 (CN) ..... 202223422319.2

(51) Int. Cl.
*H01K 1/22* (2006.01)
*H01K 1/16* (2006.01)
*H01K 1/14* (2006.01)

(52) U.S. Cl.
CPC ..... *H01K 1/22* (2013.01); *H01K 1/14* (2013.01); *H01K 1/16* (2013.01)

(58) Field of Classification Search
CPC .. H01K 1/22; H01K 1/14; H01K 1/16; H01K 1/18
See application file for complete search history.

(56) References Cited

U.S. PATENT DOCUMENTS 5,659,222 A * 8/1997 Ragsdale ..... H01K 1/18 313/623
2004/0008525 A1* 1/2004 Shibata ..... F21K 9/232 362/240
2016/0203970 A1* 7/2016 Urushibara ..... H01K 1/18 313/578

* cited by examiner

*Primary Examiner* — Anne M Hines
(74) *Attorney, Agent, or Firm* — Thompson Coburn LLP; Steven M. Ritchey

(57) ABSTRACT

Disclosed is a filament support and a lamp with the filament support. The filament support may include a main rod, a plurality of branch rods and a plurality of support members. The plurality of branch rods are all installed on the main rod; the support members are arranged at ends of at least some of the branch rods, both ends of the support member are curved or bent towards a same side, resulting in that the support member surrounds to form a penetrating zone, and an opening for communicating the penetrating zone is formed between both ends of the support member. Both ends of the support member are curved or bent towards a same side, resulting in that the support member surrounds to form a penetrating zone, and an opening for communicating the penetrating zone is formed between both ends of the support member.

10 Claims, 6 Drawing Sheets

A

B

FILAMENT SUPPORT AND LAMP

CROSS-REFERENCE TO RELATED APPLICATIONS

The present disclosure claims priority to and the benefit of Chinese Patent Application No. 202223422319.2 filed Dec. 19, 2022, the contents of which are incorporated herein by reference.

TECHNICAL FIELD

The present disclosure relates to the field of lighting technology, and in particular to a filament support and a lamp.

BACKGROUND

At present, a filament is used for lighting in part of lamps. However, due to the soft nature of the filament, the filament in the existing technologies is generally supported by a bracket, the bracket includes a main rod and a plurality of branch rods. The branch rods are arranged on the main rod, and an end of the branch rod is provided with a ring. The filament is passed thorough each ring, and thus the bracket can support the filament. However, with the improvement of living standards, in order to improve the aesthetics of the lamps, the forms of the bracket in the lamps are more and more complex, and the number of rings on the bracket is also increasing. During the manufacture of the lamps, the workers are required to pass the filament through the rings one by one. With the increase of the number of rings, it is more difficult for the workers to arrange the filament on the filament bracket.

SUMMARY

The present disclosure aims at solving at least one of technical problems existing in the existing technology. In accordance with a first aspect of the present disclosure, an embodiment provides a filament support, which can reduce the difficulty for workers to arrange a filament on the filament support. In accordance with a second aspect of the present disclosure, an embodiment further provides a lamp.

A filament support provided according to the embodiment of first aspect of the present disclosure may include a main rod, a plurality of branch rods and a plurality of support members; the plurality of branch rods are all installed on the main rod; the support members are arranged at ends of at least part of the branch rods, both ends of the support member are curved or bent towards a same side, resulting in that the support member surrounds to form a penetrating zone, and an opening for communicating the penetrating zone is formed between both ends of the support member.

The filament support of the present disclosure at least has the following beneficial effects: both ends of the support member are curved or bent towards a same side, resulting in that the support member surrounds to form a penetrating zone, and an opening for communicating the penetrating zone is formed between both ends of the support member. When the workers install the filament, the filament can be directly clamped into the penetrating zone from the opening. Compared with a circular support member, in the embodiment of the present disclosure the workers can pass the filament through the penetrating zone without putting fingers between the two support members, thus reducing the difficulty for the workers to install the filament on the filament support.

According to the filament support of the embodiment of first aspect of the present disclosure, the support member is in a shape of penannular jade ring.

According to the filament support of the embodiment of first aspect of the present disclosure, the main rod may include an installation segment and a connection segment, the branch rods are installed on the installation segment, and the connection segment is used for detachably connecting to a lamp holder.

According to the filament support of the embodiment of first aspect of the present disclosure, a cross section profile of the connection segment is a polygon.

According to the filament support of the embodiment of first aspect of the present disclosure, the main rod may further include a butting segment, both ends of the butting segment are connected with the installation segment and the connection segment respectively, the butting segment is in a trumpet shape with a cross section increased in a direction towards the connection segment, the butting segment has a butting surface formed at an end thereof close to the connection segment, and the butting surface is used for butting to the lamp holder.

According to the filament support of the embodiment of first aspect of the present disclosure, the main rod, the branch rod and the support member are made of a same material and are integrated into a whole.

A lamp provided according to the embodiment of second aspect of the present disclosure may include a filament support provided in the embodiment of the first aspect of the present disclosure and a filament, where the filament is passed thorough the penetrating zone.

The lamp provided according to the embodiment of second aspect of the present disclosure may further include a lamp holder, where the lamp holder is provided with two conductive connectors, both ends of the filament are electrically connected to the two conductive connectors respectively, the main rod may include a connection segment, and the connection segment is detachably connected with the lamp holder.

According to the lamp the embodiment of second aspect of the present disclosure, the lamp holder is provided with an installation groove matched with the connection segment, and the connection segment is inserted into the installation groove.

According to the lamp the embodiment of second aspect of the present disclosure, the filament support may further include a butting segment, the butting segment has an end butted with the connection segment respectively, the butting segment is in a trumpet shape with a cross section increased in a direction towards the connection segment, the butting segment has a butting surface is formed at an end thereof close to the connection segment, and the butting surface is butted with the edge of the installation groove.

Additional aspects and advantages of the present disclosure will be partially given in the following description, and the aspects and advantages will become obvious from the following description, or learned from the practice of the present disclosure.

BRIEF DESCRIPTION OF THE DRAWINGS

The present disclosure will be further described in conjunction with the accompanying drawings and embodiments hereinafter.

Figure 1:
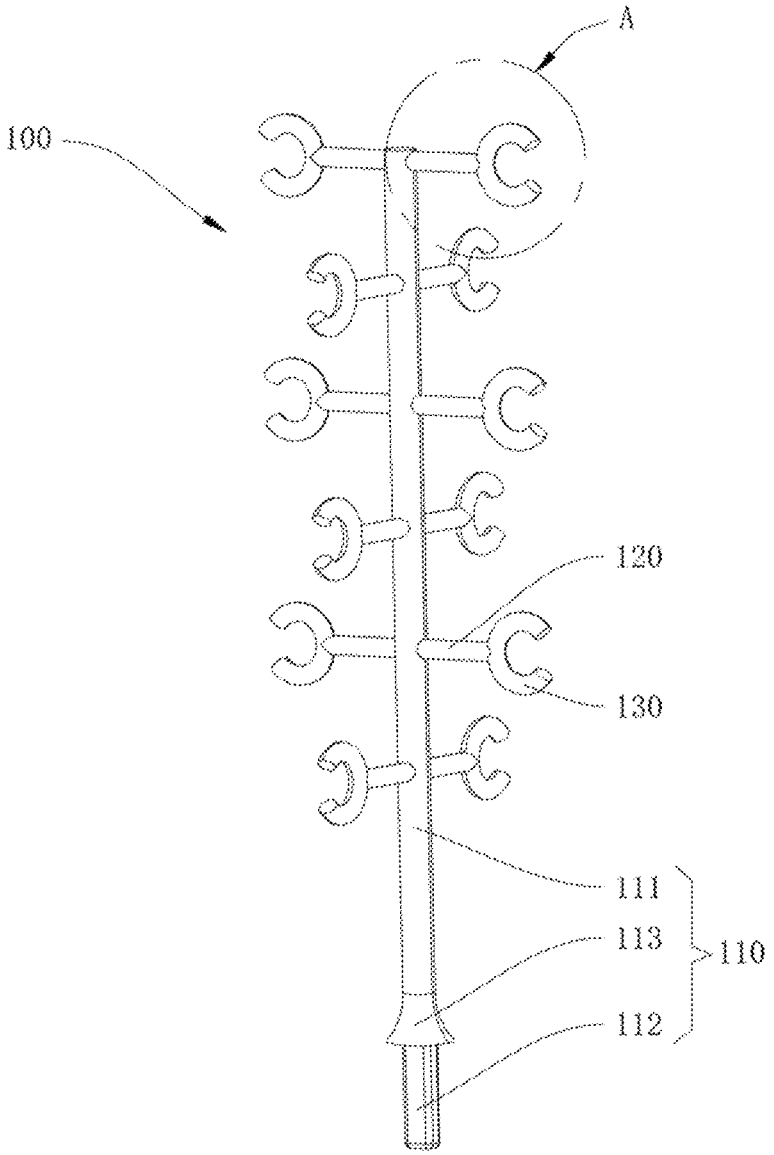
FIG. 1 is a structural schematic diagram of a filament support of one embodiment of the present disclosure.

Reference numerals:

filament support 100; main rod 110; installation segment 111; connection segment 112; butting segment 113; branch rod 120; support member 130; penetrating zone 131; opening 132; filament 200; lamp holder 300; installation groove 301; conductive connector 310; and lamp shade 400.

DETAILED DESCRIPTION

The specific embodiments of the present disclosure will be described in the part in detail. The preferred embodiments of the present disclosure are shown in the accompanying drawings. The accompanying drawings are used to supplement the description of the text part of the specification with diagrams, so that readers can intuitively and vividly understand each technical feature and the overall technical scheme of the present disclosure, but the above description is not intended as a limitation to the protection scope of the present disclosure.

In the description of the present disclosure, it should be understood that the orientation or position relation related to the orientation description, such as the orientation or position relation indicated by the upper, lower, front, rear, left, right, etc., is based on the orientation or position relation shown in the drawings, which is only used for convenience of description of the present disclosure and simplification of description instead of indicating or implying that the corresponding device or element must have a specific orientation and must be constructed and operated in a specific orientation, and thus the orientation description shall not be understood as a limitation to the present disclosure.

In the description of the present disclosure, "several" means "one" or "a plurality of", and "a plurality" means "more than two". "Greater than, less than, and more than" are understood to exclude the corresponding number, while "above, below and within" are understood to include the corresponding number. If first and second are described, the descriptions are used for the purpose of distinguishing the technical features only, and cannot be understood as indicating or implying relative importance, or implicitly indicating the number of technical features indicated thereby, or implicitly indicating the order of technical features indicated thereby.

In the description of the present disclosure, unless otherwise clearly defined, words such as setting, installation, connection, and the like, shall be understood broadly, and those skilled in the art can reasonably determine the specific meanings of the above words in the present disclosure in combination with the specific contents of the technical solution.

The filament holder 100 and the lamp of the present disclosure are described in detail below referring to FIG. 1 to FIG. 6.

Figure 2:
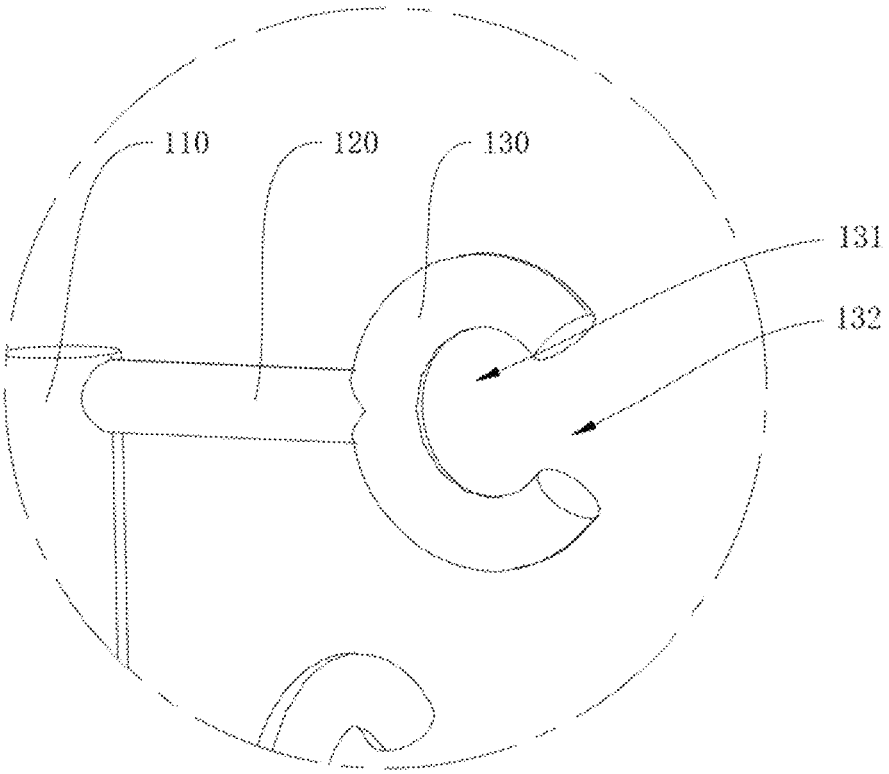
FIG. 2 is a partial enlarged diagram of a structure at A of the filament support as shown in FIG. 1.

Referring to FIG. 1 and FIG. 2, the filament support 100 according to the embodiment of the first aspect of the present disclosure includes a main rod 110, a plurality of branch rods 120 and a plurality of support members 130.

The plurality of branch rods 120 are all installed on the main rod 110; the support members 130 are arranged at ends of at least some of the branch rods 120, both ends of the support member 130 are curved or bent towards a same side, resulting in that the support member 130 surrounds to form a penetrating zone 131, and an opening 132 for communicating the penetrating zone 131 is formed between both ends of the support member 130.

For example, as shown in FIG. 1 and FIG. 2, the main rod 110 is provided with the plurality of branch rods 120. One end of the branch rod 120 is connected with the main rod 110, and the other end of the branch rod 120 is connected with the support member 130. Both ends of the support member 130 are curved or bent towards a same side, resulting in that the support member 130 surrounds to form a penetrating zone 131, and an opening 132 for communicating the penetrating zone 131 is formed between both ends of the support member 130. When installing the filament 200 on the filament holder 100, the workers can clamp the filament 200 into the penetrating zone 131 through the opening 132, thereby realizing the installation of the filament 200 on the filament support 100. The installation process of the filament 200 is simple. By arranging a plurality of branch rods 120 on the main rod 110, and arranging the support members 130 at the ends of the branch rods 120, the workers can arrange each support members 130 in different shapes, thereby controlling the overall shape of the filament 200. The plurality of support members 130 are provided to improve the diversity of the shape of the filament 200.

In some embodiments of the present disclosure, the support member 130 is in a shape of penannular jade ring (in an annular shape with a notch). Each part of the support member 130 in the shape of penannular jade ring has little measurement discrepancy and is convenient to manufacture.

In an implementation, the support member 130 can also be in a shape of square ring with an opening 132.

In some embodiments of the present disclosure, referring to FIG. 1, the main rod 110 includes an installation segment 111 and a connection segment 112, the branch rods 120 are installed on the installation segment 111, and the connection segment 112 is used for detachably connecting to a lamp holder. By setting a detachable connection form between the filament support 100 and the lamp holder 300, the filament support 100 and the lamp holder 300 can be manufactured separately, and thus reducing the manufacturing difficulty of the filament support 100 and the lamp holder 300. Due to the detachable connection between the filament support 100 and the lamp holder 300, the filament support 100 is easily installed on and detached from the lamp holder 300 by the workers, resulting in that the installation segments 111 of different main rods 110 can be set by the workers in a same style, and the filament supports 100 in different styles can be installed on the same lamp holder 300, so as to reduce the production cost of the lamp.

In some embodiments of the present disclosure, a section profile of the connection segment 112 is a polygon. For example, the cross section profile of the connection segment 112 can be a triangle, or can be a quadrangle.

In some embodiments of the present disclosure, referring to FIG. 1, the main rod 110 further includes a butting segment 113, both ends of the butting segment 113 are connected with the installation segment 111 and the connection segment 112 respectively, the butting segment 113 is in a trumpet shape with a cross section increased in a direction towards the connection segment 112, the butting segment 113 has a butting surface formed at an end thereof close to the connection segment 112, and the butting surface is used for butting to the lamp holder 300. When the filament support 100 is installed on the lamp holder 300, the connection segment 112 can be inserted into the lamp holder 300. In this case, the butting surface can be butted with the lamp holder 300. The setting of the butting segment 113 can limit the length of the main rod 110 being inserted into the lamp holder 300.

In some embodiments of the present disclosure, the main rod 110, the branch rod 120 and the support member 130 are made of a same material and are integrated into a whole. Furthermore, when manufacturing the filament holder 100, the workers can cast the entire filament support 100 by using a model at one time, which improves the production efficiency of the filament support 100.

Figure 3:
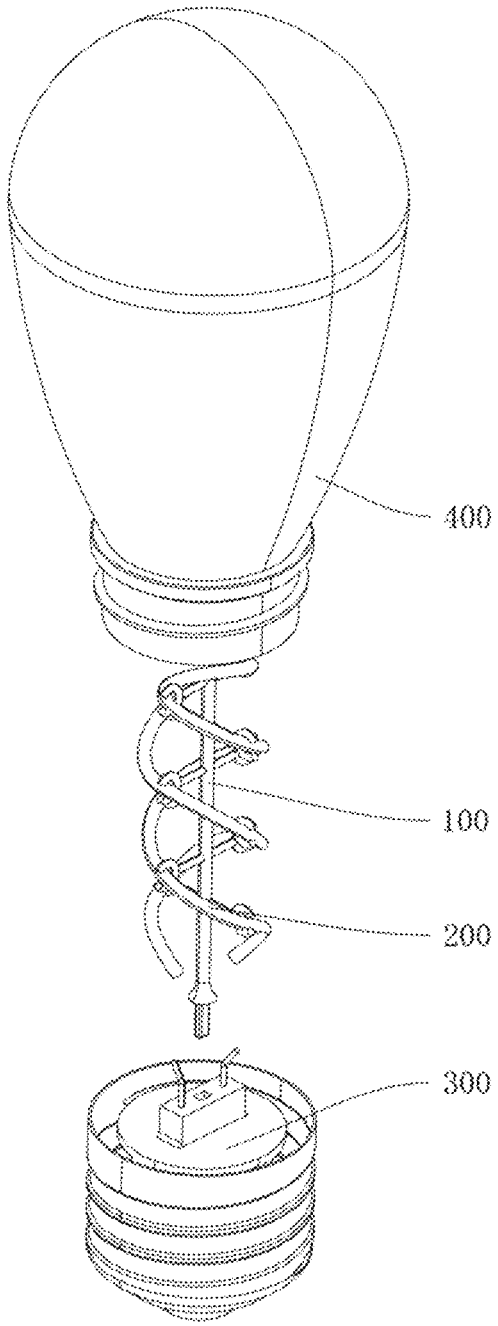
FIG. 3 is an exploding diagram of a lamp of one embodiment of the present disclosure.
Figure 4:
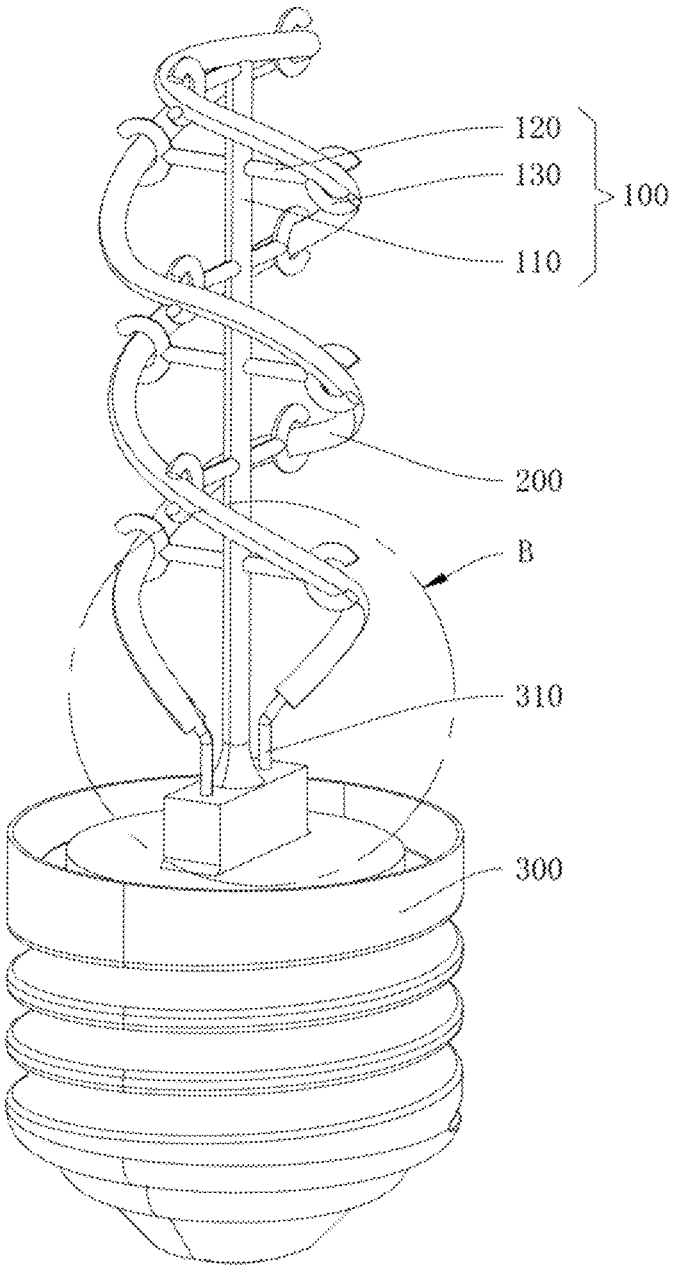
FIG. 4 is a structural schematic diagram of the lamp of one embodiment of the present disclosure after removing a lamp shade.

Referring to FIG. 3 and FIG. 4, the lamp according to the embodiment of the second aspect of the present disclosure includes the filament support 100 provided in the embodiment of the first aspect of the present disclosure and a filament 200, and the filament 200 is passed thorough the penetrating zone 131.

In some embodiments of the present disclosure, referring to FIG. 3 to FIG. 6, the lamp further includes a lamp holder 300, the lamp holder 300 is provided with two conductive connectors 310, both ends of the filament 200 are electrically connected to the two conductive connectors 310 respectively, the main rod 110 includes a connection segment 112, and the connection segment 112 is detachably connected with the lamp holder 300. Due to the setting of the connection segment 112 on the main rod 110, the connection segments 112 of the filament supports 100 in different styles can be set in the same style, resulting in that the filament supports 100 in different styles can be detachably installed on the lamp holder 300, and thus reducing the production cost of the lamp. Both ends of the filament 200 are connected to the two conductive connectors 310 respectively. When the lamp is working, the power supply can be electrically connected with the filament 200 via the conductive connector 310, thereby electrifying the filament 200.

Figure 6:
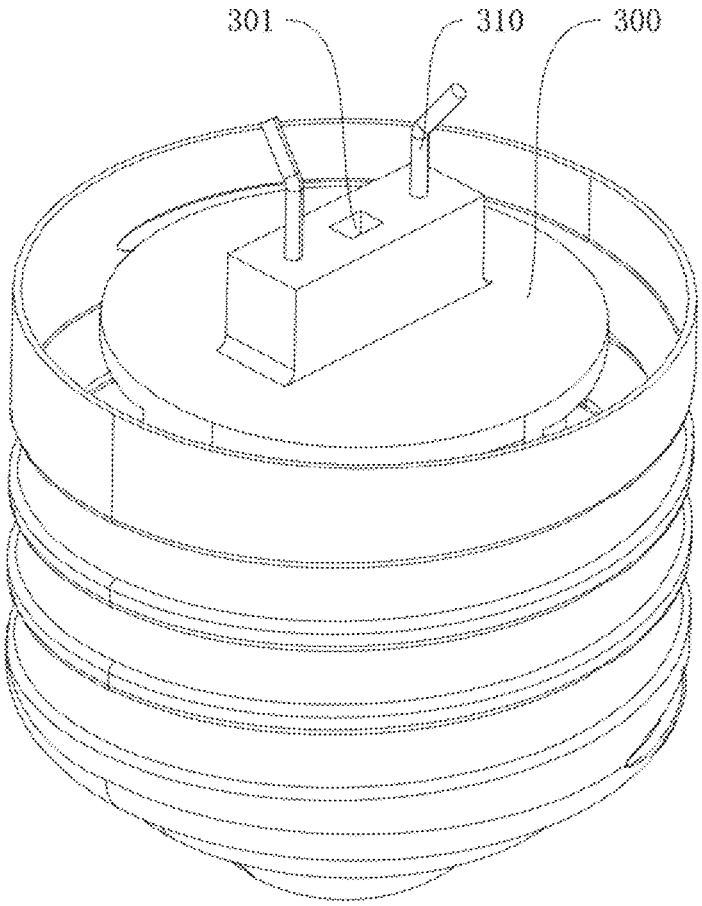
FIG. 6 is a structural schematic diagram of a lamp holder of the lamp as shown in FIG. 4.

In some embodiments of the present disclosure, referring to FIG. 6, the lamp holder 300 is provided with an installation groove 301 matched with the connection segment 112, and the connection segment 112 is inserted into the installation groove 301. The installation groove 301 has a simple structure and is easy to realize, and a connection form between the connection segment 112 and the installation groove 301 is simple, which reduces the difficulty for the workers to install the filament support 100 on the lamp holder 300.

It should be understood that, the cross section profile of the connection segment 112 is a polygon. Correspondingly, the cross section profile of the installation groove 301 can also be a polygon, resulting in that the connection segment 112 can be inserted into the installation groove 301, and thus realizing the detachable connection between the filament support 100 and the lamp holder 300.

Figure 5:
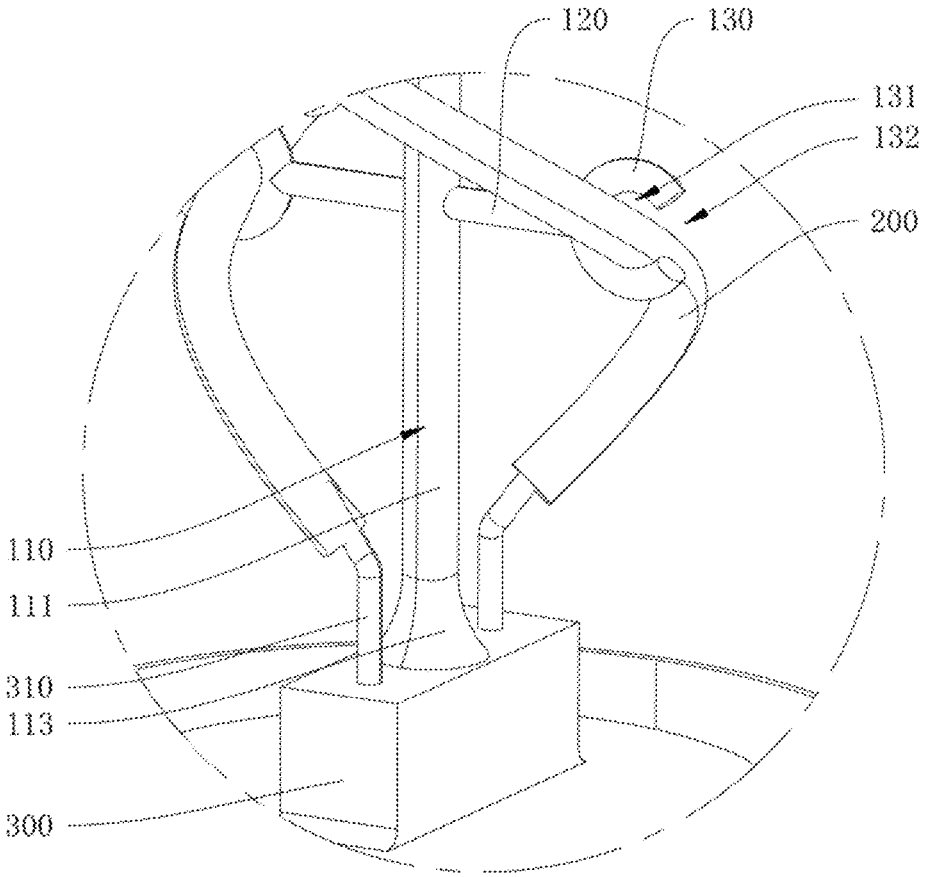
FIG. 5 is a partial enlarged diagram of a structure at B of the lamp as shown in FIG. 4.

In some embodiments of the present disclosure , referring to FIG. 5, the filament support 100 further includes a butting segment 113, the butting segment 113 has an end butted with the connection segment 112 respectively, the butting segment 113 is in a trumpet shape with a cross section increased in a direction towards the connection segment 112, the butting segment 113 has a butting surface is formed at an end thereof close to the connection segment 112, and the butting surface is butted with the edge of the installation groove 301. For example, the cross-sectional dimensions of each part of the butting segment 113 can be larger than the cross-sectional dimensions of the connection segment 112. The butting segment 113 can be butted with the edge of the installation groove 301 to limit the depth of the filament support 100 being inserted into the installation groove 301 after the connection segment 112 is inserted into the installation groove 301; at the same time, the butting section 113 can be set to increase the stability of the connection between the filament support 100 and the lamp holder 300.

In an implementation, the external surface of the connection segment 112 can be provided with external threads, and the groove wall of the installation groove 301 can be provided with internal threads. In this case, the connection segment 112 is in threaded connection with the installation groove 301.

In some embodiments of the present disclosure, referring to FIG. 3, the lamp also includes a lamp shade 400, and the lamp shade 400 is threaded with the lamp holder 300.

Although the embodiments of the present disclosure have been shown and described herein, those skill in the art can understand that a variety of changes, modifications, replacements and modifications can be made to these embodiments without departing from the principle and purpose of the present disclosure. The scope of the present disclosure is defined by claims and equivalents thereof.

What is claimed is:

1. A filament support, comprising:

a main rod;

a plurality of branch rods, wherein the plurality of branch rods are installed on the main rod; and a plurality of support members, wherein the support members are arranged at ends of at least some of the branch rods, and both ends of the support member are curved or bent towards a same side, resulting in that the support member surrounds to form a penetrating zone, and an opening for communicating the penetrating zone is formed between both ends of the support member.

2. The filament support according to claim 1, wherein the support member is in a shape of penannular jade ring.

3. The filament support according to claim 1, wherein the main rod comprises an installation segment and a connection segment, the branch rods are installed on the installation segment, and the connection segment is used for detachably connecting to a lamp holder.

4. The filament support according to claim 3, wherein a cross section profile of the connection segment is a polygon.

5. The filament support according to claim 3, wherein the main rod further comprises a butting segment, both ends of the butting segment are connected with the installation segment and the connection segment respectively, the butting segment is in a trumpet shape with a cross section increased in a direction towards the connection segment, the butting segment has a butting surface formed at an end thereof close to the connection segment, and the butting surface is used for butting to the lamp holder.

6. The filament support according to claim 1, wherein the main rod, the branch rod and the support member are made of a same material and are integrated into a whole.

7. A lamp, comprising the filament support according to claim 1 and a filament, wherein the filament passes thorough the penetrating zone.

8. The lamp according to claim 7, further comprising a lamp holder, wherein the lamp holder is provided with two conductive connectors, both ends of the filament are electrically connected to the two conductive connectors respectively, the main rod comprises a connection segment, and the connection segment is detachably connected with the lamp holder.

9. The lamp according to claim 8, wherein the lamp holder is provided with an installation groove matched with the connection segment, and the connection segment is inserted into the installation groove.

10. The lamp according to claim 9, wherein the filament support further comprises a butting segment, the butting segment has an end butted with the connection segment respectively, the butting segment is in a trumpet shape with a cross section increased in a direction towards the connection segment, the butting segment has a butting surface formed at an end thereof close to the connection segment, and the butting surface is butted with the edge of the installation groove.

* * * * *